US010889405B2

(12) United States Patent
Bojie

(10) Patent No.: US 10,889,405 B2
(45) Date of Patent: Jan. 12, 2021

(54) INTEGRATED INSERT FOR CARDED PRODUCT STABILIZATION

(71) Applicant: WestRock Shared Services, LLC, Atlanta, GA (US)

(72) Inventor: Andrew M. Bojie, Lewisville, NC (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/444,591

(22) Filed: Jun. 18, 2019

(65) Prior Publication Data

US 2019/0382158 A1 Dec. 19, 2019

Related U.S. Application Data

(60) Provisional application No. 62/686,930, filed on Jun. 19, 2018.

(51) Int. Cl.
*B65D 85/48* (2006.01)
*B65D 5/50* (2006.01)
*B65D 5/54* (2006.01)

(52) U.S. Cl.
CPC ..... *B65D 5/5021* (2013.01); *B65D 5/5445* (2013.01)

(58) Field of Classification Search
CPC ..... B65D 5/504; B65D 5/5021; B65D 5/5445
USPC ..... 206/45.28, 45.29, 485, 589, 774, 449, 206/590; 229/164, 200, 120.08, 120.13, 229/120.17, 120.18, 120.23, 120.33, 229/120.34
See application file for complete search history.

(56) References Cited

U.S. PATENT DOCUMENTS 2,620,962 A * 12/1952 Powell ..... B65D 5/5021 206/485
4,025,039 A * 5/1977 Croll ..... B65D 5/5014 206/485
4,193,532 A * 3/1980 Okubo ..... B65D 5/5016 206/488
4,485,922 A * 12/1984 Desmond ..... B65D 5/5021 206/485
4,832,199 A * 5/1989 Rigby ..... B65D 5/5021 206/485
5,505,309 A * 4/1996 Taravella ..... B65D 5/5021 206/485
5,529,187 A * 6/1996 DeNola ..... B65D 5/5021 206/449
7,624,876 B1 * 12/2009 Green ..... B65D 75/322 206/485
7,735,649 B2 * 6/2010 Kim-Gifford ..... B65D 5/504 206/485
9,828,131 B2 * 11/2017 James ..... B65D 5/5021

* cited by examiner

*Primary Examiner* — Luan K Bui
(74) *Attorney, Agent, or Firm* — John Swingle

(57) ABSTRACT

A carded product stabilization device includes a box-like structure in which two folded sections having slots for receiving a carded product. The portions of the folded sections having slots are angled with respect to the walls of the box-like structure via folded portions. The folded portions may be perpendicular to the walls of the box-like structure and connected thereto via fold lines.

13 Claims, 5 Drawing Sheets

INTEGRATED INSERT FOR CARDED PRODUCT STABILIZATION

REFERENCE TO RELATED APPLICATION

This application claims the benefit of priority under 35 U.S.C. § 119(e) of U.S. provisional application Ser. No. 62/686,930 filed on Jun. 19, 2018, which is hereby incorporated by reference in its entirety.

FIELD OF THE INVENTION

This present invention relates to a support system for use in containers and other storage devices used during shipment and for display, e.g., at points of sale of the products contained therein.

BACKGROUND OF THE INVENTION

Shelf-ready packaging for carded products fails to sufficiently retain and provide a means for displaying such carded products at the point of sale.

SUMMARY OF THE INVENTION

An exemplary carded product stabilization device may comprise at least four sections adjoined to one another via a plurality of first fold lines to form a box-like structure in which there is a first section and a second section adjoined to two of those four sections. The first section may be adjoined to at least one of the at least four sections via a second fold line that is orthogonal to at least one of the first fold lines. The first section may be folded along the second fold line so as to have at least one first portion, the first portion being orthogonal to one of the four sections. The first section may also have at least one second portion, the second portion being acutely angled with respect to the first portion. An exemplary first section comprises at least one slot spanning at least into the first portion. An exemplary second section may be adjoined to at least one of the at least four sections via a second fold line that is orthogonal to at least one of the first fold lines. The second section may be folded along the second fold line so as to have at least one first portion, the first portion being orthogonal to one of the four sections. The second section may also have at least one second portion, the second portion being acutely angled with respect to the first portion. An exemplary second section may also comprise at least one slot spanning at least into the first portion.

An exemplary carded product stabilization device may comprise at least four sections adjoined to one another via a plurality of first fold lines to form a box-like structure. A slotted surface may extend from at least one of the at least four sections and may be disposed within the box-like structure at an acute angle with respect to the at least one of the at least four sections and span the width of the at least one of the at least four sections.

BRIEF DESCRIPTION OF DRAWINGS

In the drawings like characters of reference indicate corresponding parts in the different and interchangeable and interrelated figures. Parts and components of each figure may be substitutes for other components in other figures to achieve the various methods and embodiments disclosed herein.

DETAILED DESCRIPTION

Figure 1:
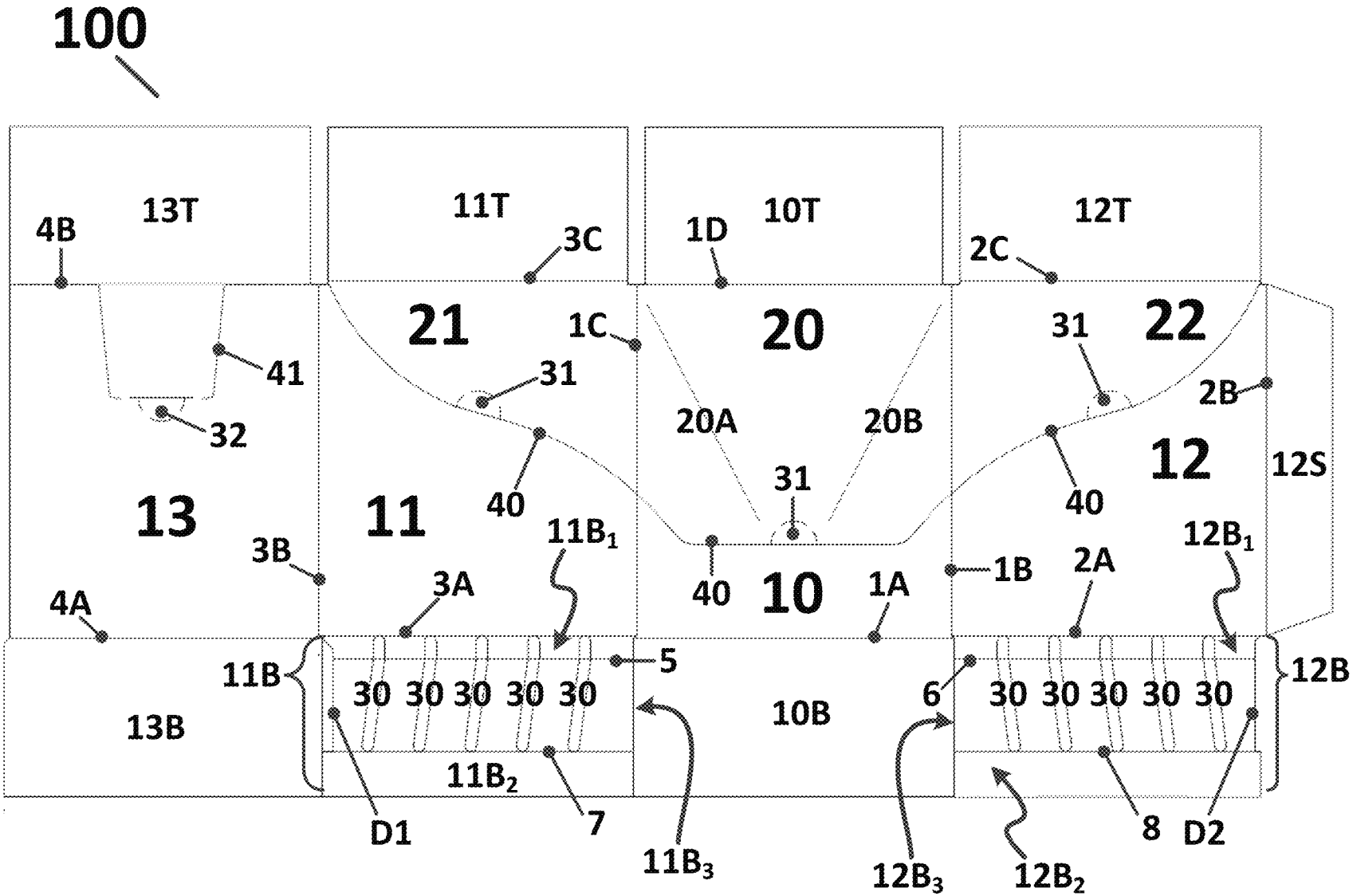
FIG. 1 illustrates an embodiment of an unassembled integrated insert for carded products.

FIG. 1 is an illustrative embodiment of an exemplary integrated insert for carded products ("ICP") 100 in an unassembled form. An exemplary ICP 100 may be formed of a foldable structure or one which may be put together by adhesives, mechanical means, chemicals, and any other assembly methods known to those in the art. In a preferred embodiment, ICP 100 may be made of cardboard, corrugated board, paper, or other known packaging materials used by persons skilled in the art. As further illustrated in FIG. 1, ICP 100 may comprise at least four interconnected sections 10, 11, 12, and 13, with top or upper portions (10T, 11T, 12T, 13T, respectively) and bottom or lower portions (10B, 11B, 12B, 13B, respectively). As will be further described, each section and lower/upper portion may be folded with respect to any other to allow for a final structure to be rendered. As may be further illustrated in FIG. 1, cover portions 20, 21, and 22 may comprise a folded cover capable of detachment from the ICP 100 via break line 40. In a preferred embodiment, break line 40 may be perforated or scored to facilitate breakage. In another preferred embodiment, ICP 100 may be a simple tray without any cover portions 20, 21, and 22 disposed above a break line 40 Additionally, break line 40 may be abutted by a break cut-out 31, which in a preferred embodiment may be semicircular, however, any number of shapes and varieties of shapes may be useable. An additional fold line 41 and break cut-out 32 may also be found on other sections of the ICP 100, e.g., section 13. In a preferred embodiment, fold line 41 may serve as relief for taping the ICP 100 closed. According to this preferred embodiment, upon tearing at break line 40, tape (not shown) would continue to hold the top 100T and bottom 100B sections of ICP 100, thereby necessitating cutting of the same with a knife or tearing the ICP 100 sections apart. For purposes of this application, the terms "distal" and "proximal" are measured in relation to the center of the section being described (e.g., a point proximal to section 10 is a point close to section 10's geometric center).

Each of bottom sections 11B and 12B comprise a plurality of slits 30 through their thickness. The slits 30 in section 11B may extend from the section-proximal portion $\mathbf{11}B_1$ into the section-middle portion $\mathbf{11}B_3$ but may not extend elsewhere, e.g., section-distal portion $\mathbf{11}B_2$. Alternatively, slits 30 may also extend into section-distal portion $\mathbf{11}B_2$ depending on needs. In like fashion, the slits 30 in section 12B may span section-proximal portion $\mathbf{12}B_1$, section-middle portion $\mathbf{12}B_3$ as well as section-distal portion $\mathbf{12}B_2$, depending on needs. Slits 30 may be oriented substantially straight, diagonal, or a combination of each for purposes of accommodating particular needs. An exemplary section 11B may comprise two fold lines: (i) proximal fold line 5 and (ii) distal fold line 7. An exemplary section 12B may also comprise two fold lines: (i) proximal fold line 6 and (ii) distal fold line 8. Orthogonal to each proximal fold line 5/6 and distal fold line 7/8 may be an indentation D1/D2, respectively, running from the section-proximal portion $12B_1/11B_1$, respectively, distally towards the section-distal end.

With further reference to the exemplary embodiment of FIG. 1, a plurality of fold lines may be used to enable creation of a holding device, which will be illustrated in further illustrations. Each of top portions 10T, 11T, 12T, and 13T may be adjoined to their respective sections 10, 11, 12, and 13, respectively, by fold lines 1D, 3C, 2C, and 4B, respectively. Each of bottom portions 10B, 11B, 12B, and 13B may be adjoined to their respective sections 10, 11, 12, and 13, respectively, by fold lines 1A, 3A, 2A, and 4A, respectively. Further, each of sections 10, 11, 12, and 13 may be adjoined and/or interconnected to one another via fold lines. For example, an exemplary section 10 may be adjoined to a section 11 via fold line 1C. An exemplary section 10 may be adjoined to a section 12 via fold line 1B. An exemplary section 11 may be adjoined to a section 13 via fold line 3B. And an exemplary section 12 may be adjoined to a side portion 12S via fold line 2B.

In an exemplary methodology, ICP 100 may be created by a series of folds of its various sections along certain fold lines. In an exemplary embodiment, an ICP 100, as may be illustrated in FIG. 2, may be formed by (i) folding section 11 adjacent section 10 at a substantially right angle along fold line 1C; (ii) folding section 12 adjacent section 10 at a substantially right angle along fold line 1B so as to be substantially parallel with section 11; (iii) folding portion 12S adjacent section 12 at a substantially right angle along fold line 2B so as to be substantially parallel with section 10; (iv) folding section 13 adjacent section 11 (as folded prior) at a substantially right angle along fold line 3B so as to also be substantially parallel with section 10 and substantially co-planar with portion 12S; and (v) adhering or otherwise connecting section 13 to section 12S (e.g., using tape, staples, heat, using a break cut-out 32, flap made by break line 41, or combination of same).

In another exemplary embodiment, an ICP 100 may comprised interconnected and adjoined sections 10, 11, 12, 12S, and 13, with the further formation steps of (i) folding top portion 10T at a substantially right angle along fold line 1D; (ii) folding top portion 13T at a substantially right angle along fold line 4B so as to be substantially co-planar with top portion 10T (as folded); (iii) folding top portion 11T and top portion 12T along fold lines 3C and 2C, respectively, so that they are substantially co-planar; and (iv) adhering or otherwise connecting 10T, 11T, 12T, and 13T to form top 100T of ICP 100 (see FIG. 2).

Figure 2:
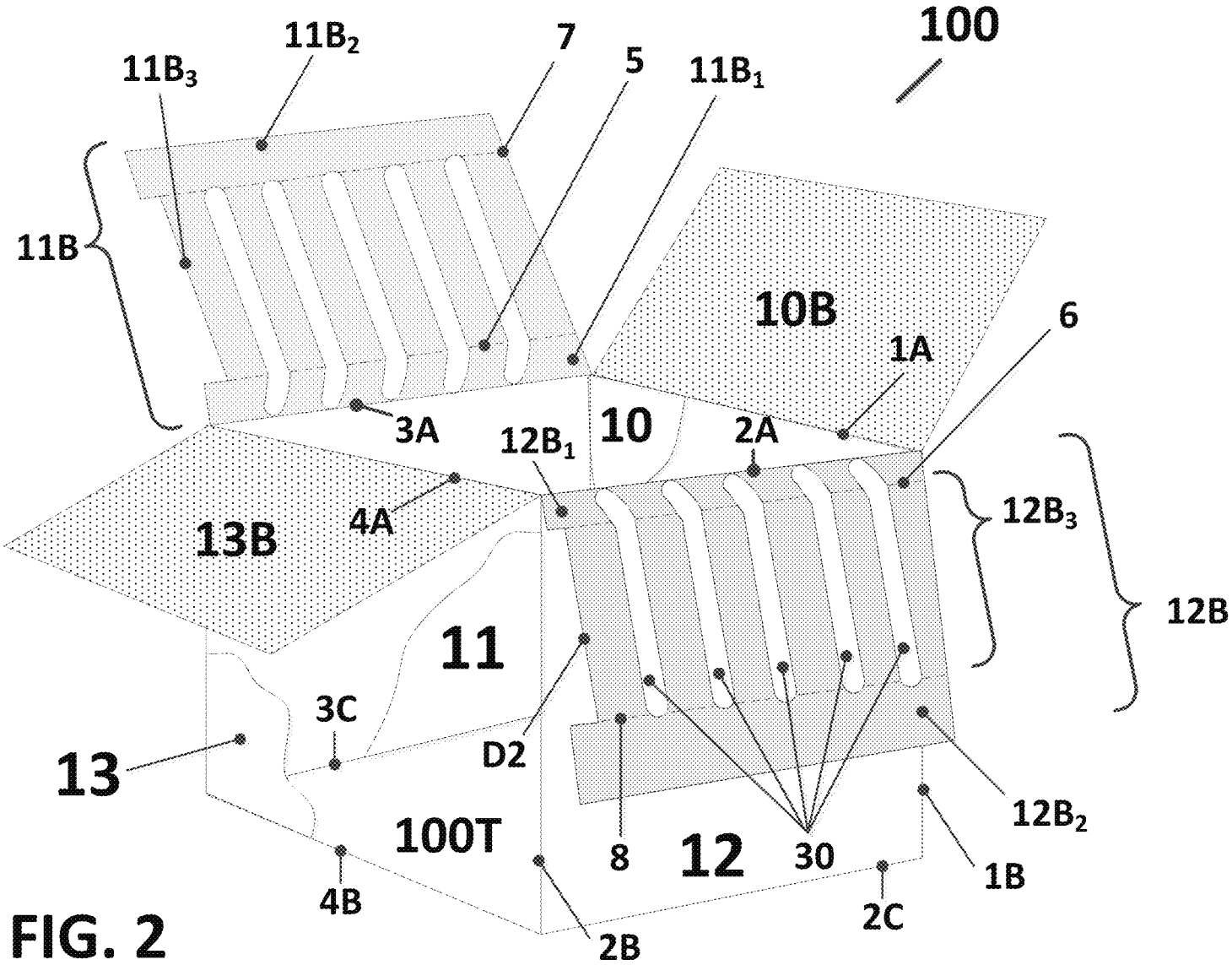
FIG. 2 illustrates an embodiment of a partially assembled integrated insert for carded products.

With reference to the exemplary embodiment illustrated by FIG. 2, a partially-assembled ICP 100 may be shown with the sections, portions, and other features illustrated in FIG. 1. In accordance with a first embodiment, an exemplary ICP 100 may be further formed by folding 11B and 12B along fold lines 3A and 2A, respectively, so that their respective section-proximal portions $11B_1$ and $12B_1$ may become substantially parallel with sections 10B and 13B, respectively, when ICP 100 is sealed. Section-middle portions $11B_3$ and $12B_3$ may be folded along fold lines 5 and 6, respectively, so that each may form an acute angle with bottom portions $11B_1$ and $12B_1$, respectively. Section-distal portions $11B_2$ and $12B_2$ may then be folded along fold lines 7 and 8, respectively, at an angle $\alpha$ greater than 90 degrees so that they are at least parallel with 11B and 12B, respectively. In a preferred embodiment, section-distal portions $11B_2$ and $12B_2$ are in contact with sections 11B and 12B, respectively, when ICP 100 is sealed. In an alternative embodiment, section-distal portions $11B_2$ and $12B_2$ may be folded to be substantially parallel with sections 11B and 12B, but be folded towards section-proximal portions $11B_1$ and $12B_1$. Once any of the aforementioned sections and section-portions are folded as described, slots 30 will also be folded in like manner and in substantially the same angles.

While FIG. 2 may illustratively depict portions 11B and 12B in splayed view, in operation, both portions may be folded inside ICP 100 in accordance with disclosures herein. Further illustrated are one of several orientations and configurations of slits 30. As illustratively provided, slits 30 may have a substantially straight section from fold lines 3A and 2A to fold lines 5 and 6, respectively. Continuing from such substantially straight sections, slits 30 may have diagonal sections from fold lines 5 and 6 to fold lines 7 and 8, respectively. Those skilled in the art may use other orientations and configurations of slits 30 in practice to hold particular contents. Further, while slits 30 may span only a subset of bottom portions 11B and 12B (e.g., $11B_1/11B_2$, and $12B_1/12B_2$, respectively) they may also be used throughout these bottom portions 11B/12B depending on needs.

Figure 3:
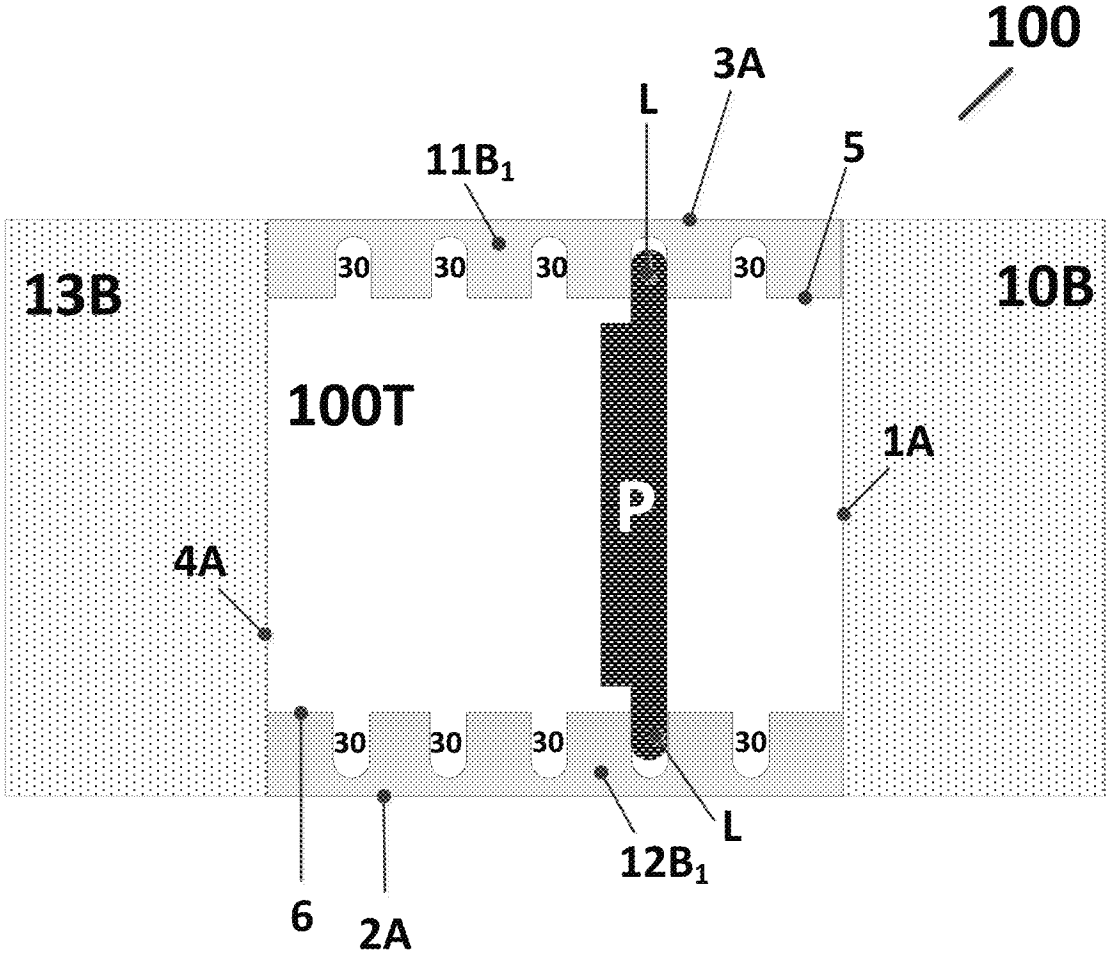
FIG. 3 illustrates an embodiment of another partially assembled integrated insert for carded products as viewed from its underside.

As may be further illustrated in FIG. 3, a product P may be placed into the bottom of ICP 100 in such a way as to be fitted within at least one slot 30 from a folded bottom portion 11B and a corresponding slot 30 from a folded bottom portion 12B. As viewed in FIG. 3, bottom sections 11B and 12B have already been folded at fold lines 3A and 2A, respectively, and are additionally folded at fold lines 5 and 6, respectively, so as to render at least section-middle portions $11B_3$ and $12B_3$ angled acutely with respect to section-proximal portions $11B_1$ and $12B_1$. Following placement of product P, bottom sections 10B and 13B may be folded so that they are substantially co-planar and then sealed to form ICP bottom 100B. Once sealed, ICP 100 may be used to transport product P in a manner that limits movement of product P in shipment. In a preferred embodiment, the distance between slots 30 in section-middle portions $11B_3$ and $12B_3$ and their respective, parallel sections 11 and 12 will be equal to the distance of land L between the edge of the product P and the edge of covering or blister packaging on product P.

Figure 4:
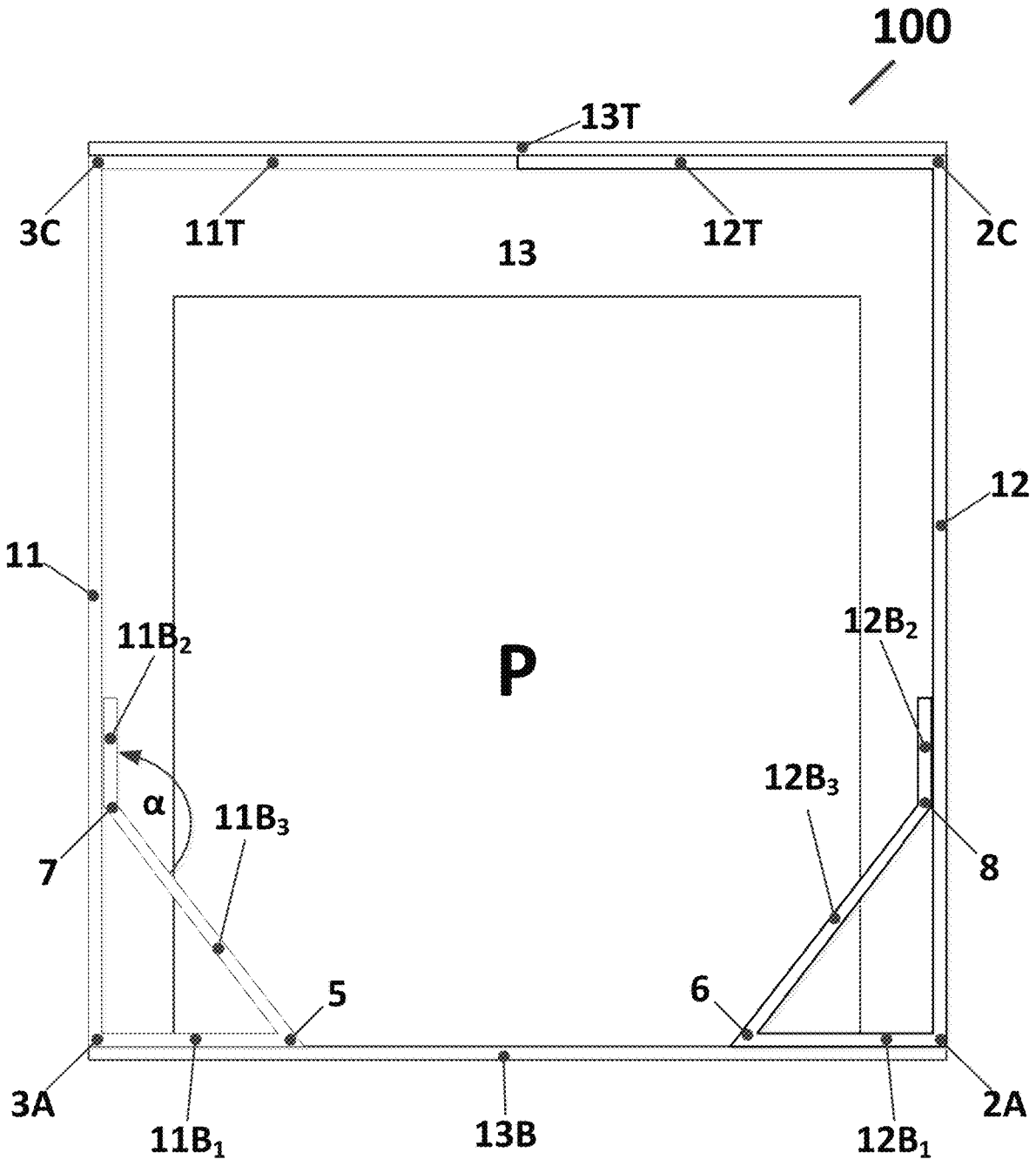
FIG. 4 illustrates an embodiment of a sealed insert for carded products viewed in a sectioned, profile view.

A profile sectional view of a sealed ICP 100 may be illustrated in FIG. 4, as illustratively provided, a loaded product P may be viewed from section 10 (not shown), thereby allowing the viewer to see opposing section 13 behind product P. From this vantage point, bottom portions 11B and 12B may be shown in folded form as described. As illustrated, section-proximal portions $11B_1$ and $12B_1$ may be folded along fold lines 3A and 2A, respectively, to allow section-proximal portions $11B_1$ and $12B_1$ to be substantially parallel with bottom sections 10B and 13B when ICP 100 is sealed. Section-middle portions $11B_3$ and $12B_3$ are folded along fold lines 5 and 6, respectively so as to form a substantially acute angle with section-proximal portions $11B_1$ and $12B_1$, respectively. According to this exemplary embodiment, slots 30 (not shown) in section-middle portions $11B_3$ and $12B_3$ may also be at the same substantially acute angle. In another exemplary embodiment, a portion of slot 30 found in section-proximal portions $11B_1$ and $12B_1$ will be parallel to bottom sections 10B and 13B. Accordingly, a product P will be held between edges of slots 30 in section-middle portions $11B_3$ and $12B_3$, and when present, the portion of slots 30 in section-proximal portions $11B_1$ and $12B_1$. In the latter scenario, a product P will rest on top of ICP bottom 100B as opposed to resting atop section-proximal portions $11B_1$ and $12B_1$ and leave a small space between product P and ICP bottom 100B.

While section-distal portions $11B_2$ and $12B_2$ may be shown in FIG. 4, these may not be necessary for all exemplary operations of ICP 100. When present, section-distal portions 11$B_2$ and 12$B_2$ may be folded along fold lines 7 and 8, respectively, so that they are at an angle greater than 90 degrees. In an exemplary embodiment, section-distal portions 11$B_2$ and 12$B_2$ may be in contact with sections 11 and 12, respectively. In another exemplary embodiment, section-distal portions 11$B_2$ and 12$B_2$ may be parallel with sections 11 and 12, respectively. In another exemplary embodiment, section-distal portions 11$B_2$ and 12$B_2$ may be in contact and parallel with sections 11 and 12, respectively. As previously described, while section-distal portions 11$B_2$ and 12$B_2$ are angled so as to point towards 11T and 12T, respectively, they may be folded and/or angled to point towards 11$B_1$ and 12$B_1$. While bottom sections 11B and 12B have been illustrated in proximal-, middle-, and distal-section portions 11$B_1$, 11$B_2$, 11$B_3$, 12$B_1$, 12$B_2$, and 12$B_3$ with a plurality of fold lines 5-8, these portions and fold lines may be divided and subdivided so long as they allow for slots 30 to receive product P and/or its land sections L. For example, where slots 30 may extend into section-distal portions 11$B_2$ and 12$B_2$, a distal-most part of section-distal portions 11$B_2$ and 12$B_2$ may be configured to rest on sections 11 and 12, respectively, so that section-distal portions 11$B_2$ and 12$B_2$ may be disposed at right angles (as opposed to angles greater than 90 degrees). As configured, slots 30 may still allow product P to be disposed in the slot 30 while also providing a shelf (e.g., the unslotted parts of section-distal portions 11$B_2$ and 12$B_2$) for particular types of land L for packaging of product P.

Figure 5:
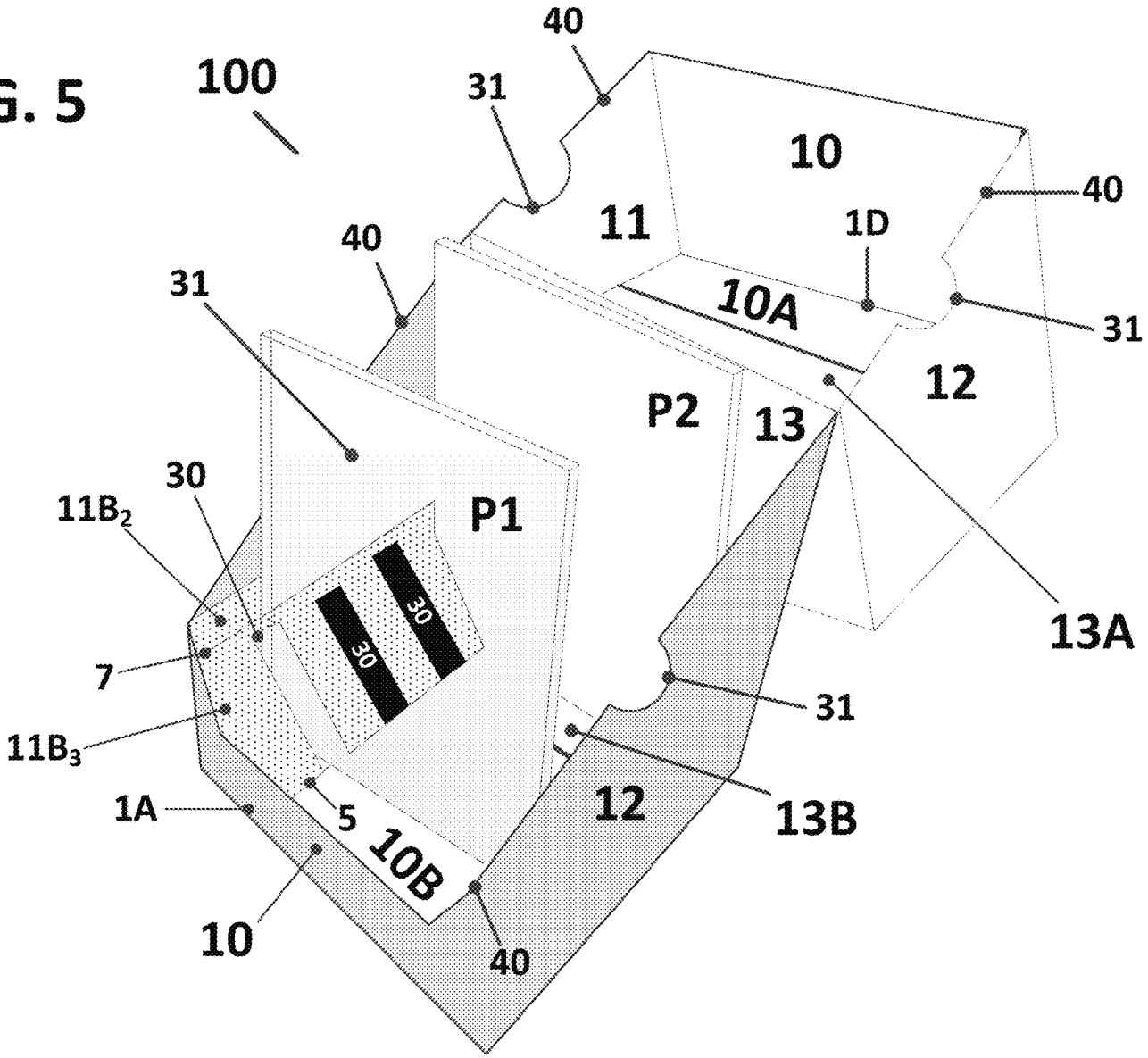
FIG. 5 illustrates an embodiment of an integrated insert for carded products in a point-of-sale configuration.

As may be illustrated in FIG. 5, ICP 100 may be opened along break line 40 using break cut-outs 31 located on ICP 100's side sections 11 and 12. When opened, ICP 100 may expose products P1 and P2 lodged within slots 30 as previously formed. In the illustrative embodiment of FIG. 4, bottom portions 11B and 12B may be illustrated with their respective section-distal portions 11$B_2$ and 12$B_2$ folded along fold lines 7 and 8 (not shown). While in certain embodiments, section-distal portions 11$B_2$ and 12$B_2$ may be useful to stabilize and support slotted section-middle portions 11$B_3$ and 12$B_3$, respectively, slots 30 may be solely supported by section-middle portions 11$B_3$ and 12$B_3$ without need for section-distal portions 11$B_2$ and 12$B_2$. In an alternative embodiment, section-distal portions 11$B_2$ and 12$B_2$ may have adhesives to hold middle sections 11$B_3$ and 12$B_3$ once folded. In a preferred embodiment, product P and/or its packaging may be used to hold section-distal portions 11$B_2$ and 12$B_2$ against sections 11 and 12, respectively.

ICP 100 of the type illustrated and described may be used as shelf-ready packaging and PDQ trays manufactured from what has traditionally been classified as "jointed containers". While ICP 100 may be shown as a box-like structure, those skilled in the art may understand that the disclosures herein may be applied to cubic and prismatic enclosures provided the slotted portions are formed in similar manner as described (this also applies to trays without top covers 21, 20, 22, 13T, 11T, 10T, 12T).

The invention claimed is:

1. A carded product stabilization device, comprising: at least four sections adjoined to one another via a plurality of first fold lines to form a box-like structure; and a first section adjoined to at least one of the at least four sections via a second fold line that is orthogonal to at least one of the first fold lines, wherein the first section is folded along the second fold line so as to have at least one first portion, the first portion being orthogonal to the at least one of the at least four sections and at least one second portion, the second portion being acutely angled with respect to the at least one first portion, wherein the first section comprises at least one slot spanning at least into the at least one first portion.

2. The carded product stabilization device of claim 1, further comprising a second section adjoined to at least one other of the at least four sections via a third fold line that is orthogonal to at least one of the first fold lines, the second section opposite the first section, wherein the second section is folded along the third fold line so as to have at least one first portion, the first portion being orthogonal to the at least one of the at least four sections and at least one second portion, the second portion being acutely angled with respect to the at least one first portion, wherein the second section comprises at least one slot spanning at least into the at least one first portion.

3. The carded product stabilization device of claim 2, wherein the at least one slot spans into the at least one second portion for the first and second sections.

4. The carded product stabilization device of claim 3, wherein the first section is folded along a third fold line so as to have at least one third portion in contact with at least one section of the at least four sections.

5. The carded product stabilization device of claim 4, wherein the second section is folded along a third fold line so as to have at least one third portion in contact with at least one section of the at least four sections.

6. The carded product stabilization device of claim 4, wherein the at least one third portion is angled greater than 90 degrees with respect to the at least one second portion of the first section.

7. The carded product stabilization device of claim 5, wherein at least one third portion is angled greater than 90 degrees with respect to the at least one second portion of the second section.

8. A carded product stabilization device, comprising: at least four sections adjoined to one another via a plurality of first fold lines to form a box-like structure; a first section adjoined to at least one of the at least four sections via a second fold line that is orthogonal to at least one of the first fold lines, wherein the first section is folded along the second fold line so as to have at least one first portion, the first portion being orthogonal to the at least one of the at least four sections and at least one second portion, the second portion being acutely angled with respect to the at least one first portion, wherein the first section comprises at least one slot spanning at least into the at least one first portion; and a second section opposite the first section and adjoined to at least one other of the at least four sections via a third fold line that is orthogonal to at least one of the first fold lines, the second section opposite the first section, wherein the second section is folded along the third fold line so as to have at least one first portion, the first portion being orthogonal to the at least one of the at least four sections and at least one second portion, the second portion being acutely angled with respect to the at least one first portion, wherein the second section comprises at least one slot spanning at least into the at least one first portion.

9. The carded product stabilization device of claim 8, wherein the at least one slot spans into the at least one second portion for the first and second sections.

10. The carded product stabilization device of claim 9, wherein the first section is folded along a third fold line so as to have at least one third portion in contact with at least one section of the at least four sections.

11. The carded product stabilization device of claim 10, wherein the second section is folded along a third fold line so as to have at least one third portion in contact with at least one section of the at least four sections.

12. The carded product stabilization device of claim 11, wherein the at least one third portion is angled greater than 90 degrees with respect to the at least one second portion of the first section.

13. The carded product stabilization device of claim 12, wherein at least one third portion is angled greater than 90 degrees with respect to the at least one second portion of the second section.

* * * * *